US007768497B2

(12) United States Patent
Lim

(10) Patent No.: US 7,768,497 B2
(45) Date of Patent: Aug. 3, 2010

(54) LIQUID CRYSTAL DISPLAY DEVICE HAVING BACKLIGHT UNIT THAT AUTOMATICALLY ADJUSTS ACCORDING TO AMBIENT BRIGHTNESS AND METHOD OF DRIVING THE SAME

(75) Inventor: Kyoung-Moon Lim, Gwangmyeong-si (KR)

(73) Assignee: LG. Display Co., Ltd., Seoul (KR)

( * ) Notice: Subject to any disclaimer, the term of this patent is extended or adjusted under 35 U.S.C. 154(b) by 778 days.

(21) Appl. No.: 11/639,919

(22) Filed: Dec. 15, 2006

(65) Prior Publication Data

US 2008/0001910 A1 Jan. 3, 2008

(30) Foreign Application Priority Data

Jun. 30, 2006 (KR) ..... 10-2006-0060854

(51) Int. Cl.
*G09G 3/36* (2006.01)

(52) U.S. Cl. ..... 345/102; 345/207

(58) Field of Classification Search ..... 345/87, 345/102, 207; 257/124, 228, 257, 292, 414, 257/461; 250/208.1, 214 AL; 348/602
See application file for complete search history.

(56) References Cited

U.S. PATENT DOCUMENTS 4,917,495 A * 4/1990 Steenhoek ..... 356/328
5,013,904 A * 5/1991 Muro ..... 250/214 R
6,462,819 B1 * 10/2002 Terauchi et al. ..... 356/406
7,573,209 B2 * 8/2009 Ashdown et al. ..... 315/307
2002/0011978 A1 * 1/2002 Yamazaki et al. ..... 345/87
2003/0052850 A1 * 3/2003 Zhang et al. ..... 345/87
2004/0012556 A1 1/2004 Yong et al.
2004/0227719 A1 11/2004 Chang et al.
2005/0151065 A1 * 7/2005 Min ..... 250/214 R
2005/0168428 A1 * 8/2005 Nakajima et al. ..... 345/99
2006/0007107 A1 * 1/2006 Ferguson ..... 345/102
2006/0077169 A1 * 4/2006 Fujikawa ..... 345/102

FOREIGN PATENT DOCUMENTS

CN 1420410 A 5/2003
EP 1 361 563 A2 11/2003
GB 2 411 039 A 8/2005
WO 97/01240 1/1997

OTHER PUBLICATIONS

Search Report dated Apr. 4, 2007 for corresponding Great Britain Patent Application No. GB0624299.4.
Office Action issued in corresponding Chinese Patent Application No. 2006101622110; issued Sep. 18, 2009.
Office Action issued in corresponding Chinese Patent Application No. 200610162211.0; issued Mar. 10, 2010.

* cited by examiner

*Primary Examiner*—Sumati Lefkowitz
*Assistant Examiner*—Rodney Amadiz
(74) *Attorney, Agent, or Firm*—Brinks Hofer Gilson & Lione

(57) ABSTRACT

A liquid crystal display device includes: a liquid crystal panel; a backlight unit supplying light to the liquid crystal panel; a photo sensor detecting an ambient luminance surrounding the liquid crystal panel and generating a current analog-type sense signal; and a signal processor adjusting a brightness of the backlight unit.

12 Claims, 4 Drawing Sheets

LIQUID CRYSTAL DISPLAY DEVICE HAVING BACKLIGHT UNIT THAT AUTOMATICALLY ADJUSTS ACCORDING TO AMBIENT BRIGHTNESS AND METHOD OF DRIVING THE SAME

This application claims the benefit of Korean Patent Application No. 2006-0060854, filed on Jun. 30, 2006, which is hereby incorporated by reference in its entirety.

TECHNICAL FIELD

The present application relates to a liquid crystal display (LCD) device and a method of driving a liquid crystal display device, and more particularly, to a liquid crystal display device including a backlight unit automatically adjusted according to an ambient brightness and a method of driving the same.

BACKGROUND

Display devices have become thinner and bigger as an industrial utilization increases. Among the various types of flat panel display (FPD) devices, liquid crystal display (LCD) devices and plasma display panel (PDP) devices are widely used.

A PDP device is an emissive type display device where light is emitted from fluorescent materials in a sidewall between two substrates in response to an applied voltage. An LCD device is a non-emissive type display device where images are displayed by adjusting light from a backlight unit with a liquid crystal layer as a light modulator. Since grey levels are displayed by a digital voltage in a PDP device, the PDP device has a disadvantage in displaying natural images. On the contrary, since an analog voltage is applied to both sides of a liquid crystal layer in an LCD device, the LCD device displays a natural image as compared with a PDP device.

Among LCD devices, an active matrix liquid crystal display (AMLCD) device is widely used. In an AMLCD device, a thin film transistor (TFT) is connected to a pixel and adjusts a voltage level of the pixel as a switching element to change light transmittance of the pixel and display images.

In FIG. 1, a liquid crystal display (LCD) device includes a liquid crystal panel 1, a gate driver 4, a data driver 6, a timing controller 7, a backlight unit 8, and a source voltage generator 9. A plurality of thin film transistors (TFTs) are disposed in matrix on the liquid crystal panel 1. The gate driver 4 controls input of a data signal into the liquid crystal panel 1, and the data driver 6 outputs the data signal to the liquid crystal panel 1. The timing controller 7 controls a timing of the gate driver 4 and the data driver 6. The backlight unit 8 is disposed underneath, and supplies light to, the liquid crystal panel 1. The backlight unit 8 includes a backlight lamp 8*a* emitting the light, and a backlight driver 8*b* to control the backlight lamp 8*a*. The source voltage generator 9 supplies source voltages to the gate driver 4, the data driver 6, the timing controller 7 and the backlight unit 8. The source voltage generator 9 is formed on a printed circuit board (PCB). Although not shown in FIG. 1, the backlight lamp 8*a* includes one of at least one fluorescent lamp or a plurality of light emitting diodes (LEDs).

Each TFT uses hydrogenated amorphous silicon (a-Si:H) for a semiconductor layer. The hydrogenated amorphous silicon yields higher productivity while being easily fabricated on a large sized substrate. In addition, since the hydrogenated amorphous silicon is deposited at a temperature less than about 350° C., a low-cost glass substrate can be used. The hydrogenated amorphous silicon is used mainly in a TFT, which is referred to as an amorphous silicon thin film transistor (a-Si TFT). However, since the hydrogenated amorphous silicon has a disordered atomic arrangement, weak silicon-silicon (Si—Si) bonds and dangling bonds exist in the hydrogenated amorphous silicon. These types of bonds become metastable when light or an electric field is applied to the hydrogenated amorphous silicon. As a result, this metastability makes the TFT unstable. Specifically, the electrical characteristics of the hydrogenated amorphous silicon are degraded due to light irradiation. Furthermore, a TFT using the hydrogenated amorphous silicon is difficult to be implemented in a driving circuit due to degraded electrical characteristics such as a low field-effect mobility between about 0.1 $cm^2$/Vsec to about 1.0 $cm^2$/Vsec, and poor reliability.

The substrate including the a-Si TFT is connected to a printed circuit board (PCB) using a tape carrier package (TCP) that has a driving integrated circuit (IC). The driving IC and its packaging increase production cost of the LCD device. As the resolution of a liquid crystal panel for an LCD device increases, a pad pitch between gate pads or between data pads of the substrate including the a-Si TFT becomes smaller. Thus, bonding of the TCP and the substrate including the a-Si TFT becomes harder.

To solve these problems, a polycrystalline silicon thin film transistor (p-Si TFT) has been suggested. Due to the higher field effect mobility of a p-Si TFT as compared to an a-Si TFT, a driving circuit can be integrated on a substrate including the p-Si TFT such that a driving element and a switching element are simultaneously formed. Accordingly, the TCP is eliminated and the production cost is reduced. Moreover, a driving system may be integrated in the liquid crystal panel. An LCD device where a driving system is integrated in a liquid crystal panel may be referred to a system-on-panel (SOP) type LCD device.

FIG. 2 is a block diagram showing a liquid crystal display device using a polycrystalline silicon thin film transistor. In FIG. 2, a liquid crystal display (LCD) device includes a liquid crystal panel 10. The liquid crystal panel 10 includes two attached substrates (not shown). A display area 12 for displaying images, and a non-display area 13 for driving the display area 12 are defined in the liquid crystal panel 10. A gate line "GL" and a data line "DL" crossing each other are formed in the display area 12. In addition, a thin film transistor (TFT) "T" is connected to the gate line "GL" and the data line "DL." A gate driver 14 and a data driver 16 are formed in the non-display area 14. The gate driver 14 and the data driver 16 receive a gate signal and a data signal from an exterior system (not shown) and control the TFT "T" in the display area 12 through the gate line "GL" and the data line "DL," thereby changing light transmittance of a liquid crystal layer between the attached two substrates. Although not shown in FIG. 2, a timing controller and a source voltage generator are formed on a printed circuit board (PCB) and connected to the liquid crystal panel 10. The backlight unit is disposed under the liquid crystal panel 10.

Since a backlight unit of an LCD device emits light of constant intensity, the display quality of the LCD device may deteriorate depending on the ambient brightness. When the backlight unit emits light of relatively low intensity, images displayed in the LCD device are poorly recognized under high ambient brightness. When the backlight unit emits light of relatively high intensity, power is wasted under low ambient brightness because emitted light of relatively low intensity is sufficient to display recognizable images.

SUMMARY

A liquid crystal display device including a backlight unit automatically adjusted according to an ambient brightness and a method of driving the liquid crystal display device is described.

A liquid crystal display device includes: a liquid crystal panel; a backlight unit supplying light to the liquid crystal panel; a photo sensor detecting an ambient luminance surrounding the liquid crystal panel and generating a sense signal proportional thereto; and a signal processor adjusting a brightness of the backlight unit according to a value of the sense signal.

In another aspect, a method of driving a liquid crystal display device includes: detecting an ambient luminance surrounding a liquid crystal panel and generating a sense signal related thereto; converting the sense signal into a digital type sense signal; generating a hysteresis signal using the digital type sense signal; generating a converted sense signal using the hysteresis signal; and adjusting a brightness of a light supplied to the liquid crystal panel according to the converted sense signal.

BRIEF DESCRIPTION OF THE DRAWINGS

The accompanying drawings, which are included to provide a further understanding of the invention and are incorporated in and constitute a part of this specification, illustrate embodiments of the invention.

DETAILED DESCRIPTION OF THE PREFERRED EMBODIMENTS

Reference will now be made in detail to embodiments which are illustrated in the accompanying drawings. Wherever possible, similar reference numbers will be used to refer to the same or similar parts.

Figure 1:
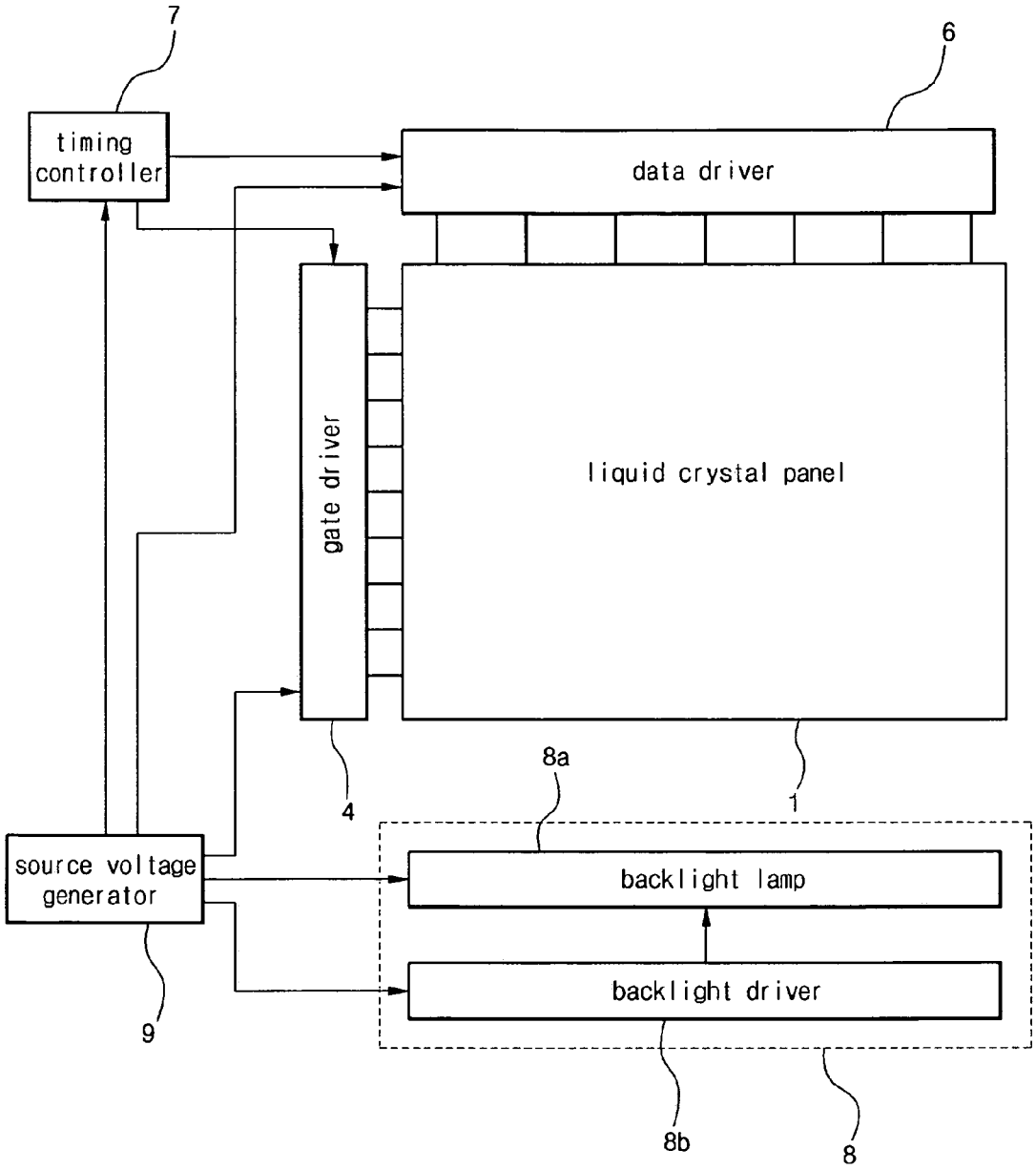
(related art) FIG. 1
FIG. 1 is a block diagram showing a liquid crystal display device according to the related art.
Figure 2:
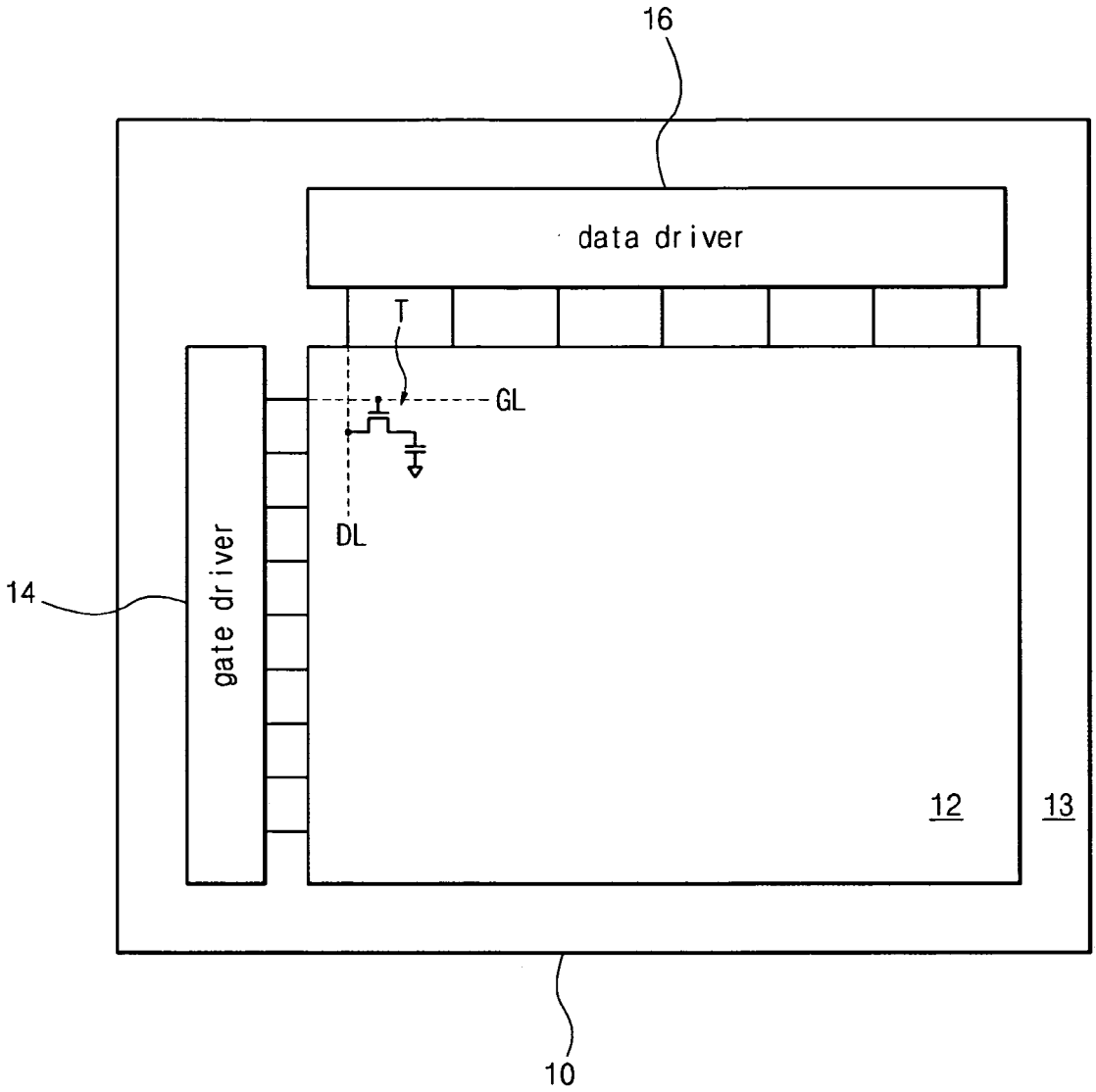
(related art) FIG. 2
FIG. 2 is a block diagram showing a liquid crystal display device using a polycrystalline silicon thin film transistor according to the related art.
Figure 3:
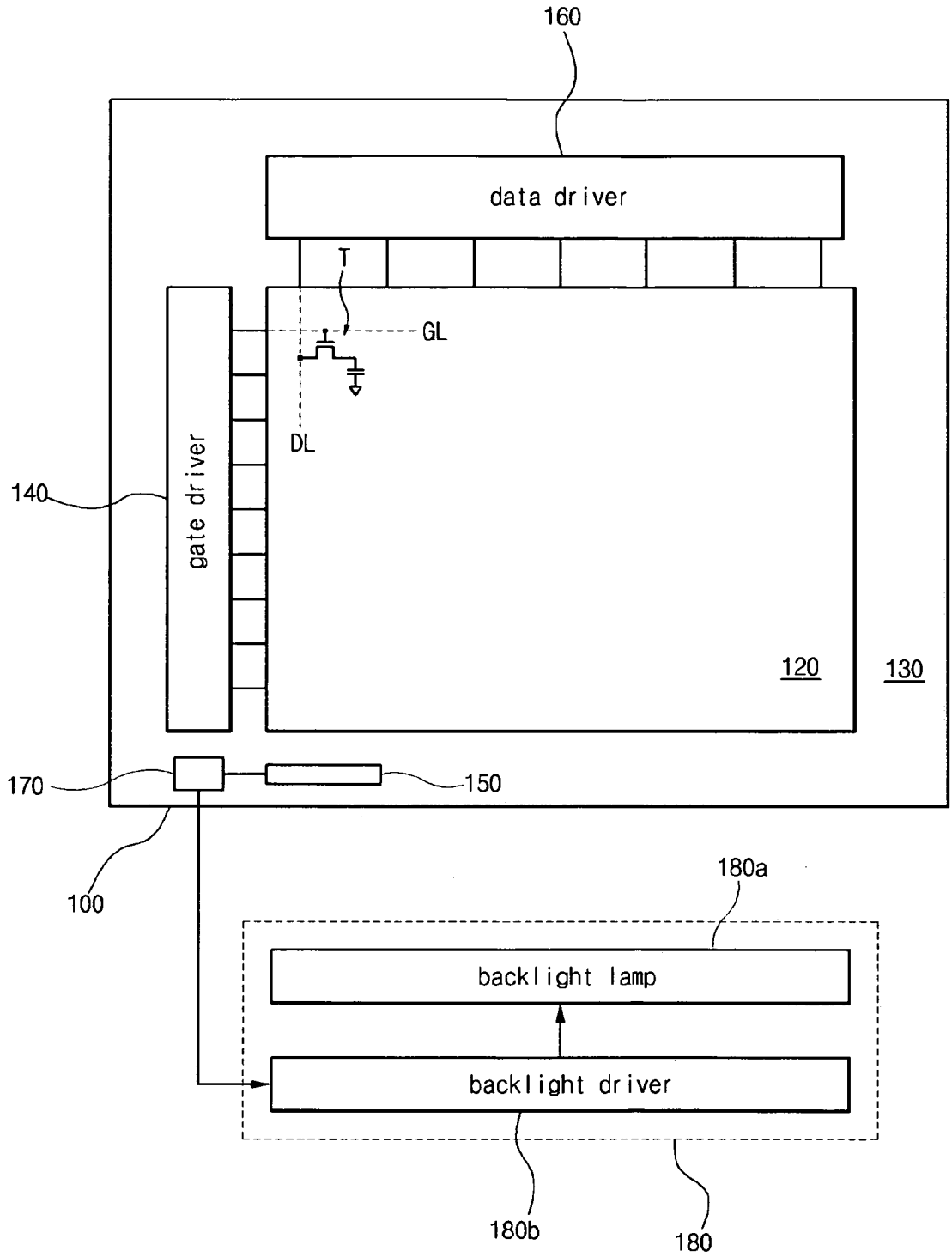
FIG. 3 is a schematic block diagram showing a liquid crystal display device according to an embodiment.

In FIG. 3, a liquid crystal display (LCD) device includes a liquid crystal panel 100 and a backlight unit 180. The liquid crystal panel 100 includes first and second substrates (not shown) and a liquid crystal layer between the first and second substrates. A display area 120 and a non-display area 130 at a periphery of the display area 120 are defined in the liquid crystal panel 100. A gate line "GL" and a data line "DL" crossing each other are formed in the display area 102 on the first substrate, and a thin film transistor (TFT) "T" is connected to the gate line "GL" and the data line "DL." In addition, a gate driver 140, a data driver 160, a photo sensor 150 and a signal processor 170 are formed in the non-display area 103 on the first substrate. The gate driver 140 controls input of a data signal into the TFT "T" using a gate signal from an external system, and the data driver 160 outputs the data signal to the TFT "T."

The photo sensor 150 may be disposed at one of the display area 120, the non-display area 130, or a boarder portion of the display area 120 and the non-display area 130. The photo sensor 150 detects an ambient brightness and generates a sense signal corresponding to the ambient brightness. For example, the photo sensor 150 may include one of a photo diode and a photo transistor where a portion sensing light may be formed of amorphous silicon and the other portion may be formed of polycrystalline silicon. The signal processor 170 connected to the photo sensor 150 converts the sense signal into a control signal. In addition, the signal processor 170 is connected to the backlight driver 180*b* of the backlight unit 180. In the LCD device according to an embodiment, the photo sensor 150 and the signal processor 170 may be formed through the same fabrication process as the TFT "T." Further, the signal processor 170 and the liquid crystal panel may include TFTs of polycrystalline silicon.

The backlight unit 180 including a backlight lamp 180*a* and a backlight driver 180*b* is disposed under and supplies light to the liquid crystal panel 100. The backlight lamp 180*a* emits the light and the backlight driver 180*b* controls the backlight lamp 180*a*. The backlight lamp 180*a* may include one of at least one fluorescent lamp or a plurality of light emitting diodes (LEDs). Although not shown in FIG. 3, the LCD device further includes a timing controller controlling a timing of the gate driver 140 and the data driver 160 and a source voltage generator supplying source voltages to the timing controller, the gate driver 140, the data driver and the backlight unit 180. The timing controller and the source voltage generator may be formed on a printed circuit board (PCB) including the external system.

The liquid crystal panel 100 displays images by changing light transmittance of the liquid crystal layer due to a switching operation of the TFT "T." The gate driver 140 receives a gate control signal from the timing controller (not shown) and generates a gate signal. The gate signal is sequentially transmitted to the TFT through the gate line "GL." The data driver 160 receives a data control signal and an image signal of a digital type, and may convert the image signal of a digital type into a data signal of an analog type. The data signal is transmitted to the TFT through the data line "DL."

The photo sensor 150 detects brightness and luminance of environment, i.e., an ambient brightness, and generates a current analog-type sense signal corresponding to the brightness and the luminance of environment. The current analog-type sense signal is transmitted to the signal processor 170. The signal processor 170 converts the current analog-type sense signal into a voltage digital-type sense signal. In addition, the signal processor 170 outputs a control signal corresponding to the voltage digital-type sense signal, and the control signal is transmitted to the backlight driver 180*b* of the backlight unit 180.

The backlight driver 180*b* adjusts a luminance of the backlight lamp 180*a* according to the control signal, and the backlight lamp 180*a* emits light to the liquid crystal panel 100. As a result, the TFT "T" is turned on/off according to the gate signal from the gate driver 140 and the data signal from the data driver 160, and the light transmittance of the liquid crystal layer is changed according to the data signal, so that the liquid crystal panel 100 displays images. When the ambient brightness is higher than a reference brightness, the backlight driver 180*b* supplies a high-level voltage to the backlight lamp 180*a* and the backlight lamp 180*a* emits light of a high-level luminance. Accordingly, deterioration of the LCD device in brightness and contrast ratio due to the high level ambient brightness is prevented. In addition, when the ambient brightness is lower than the reference brightness, the backlight driver 180*b* supplies a low-level voltage to the backlight lamp 180*a* and the backlight lamp 180*a* emits light of a low-level luminance. Accordingly, unnecessary power consumption under a circumstance of the low level ambient brightness is prevented.

Figure 4A:
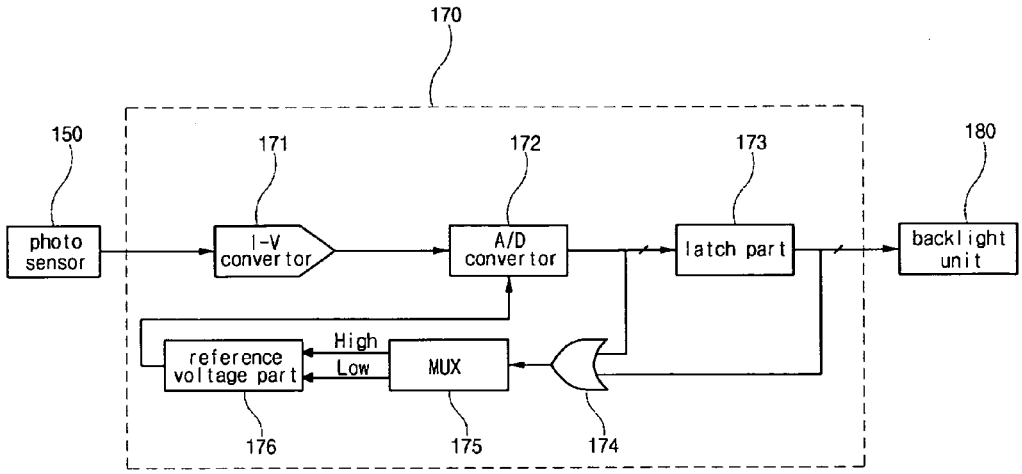
FIG. 4A is a schematic block diagram showing a signal processor of a liquid crystal display device according to a first embodiment.
Figure 4B:
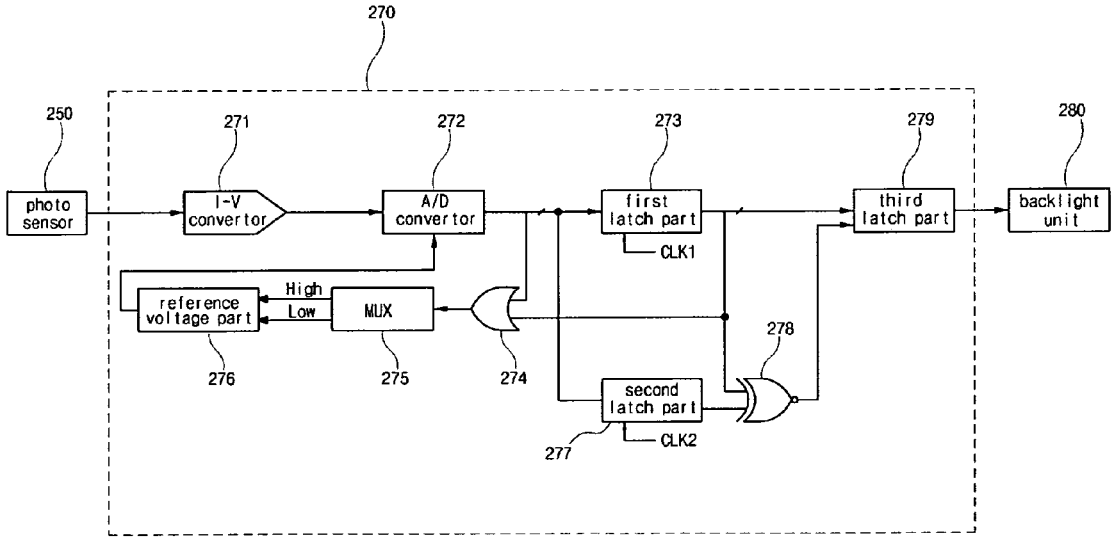
FIG. 4B is a schematic block diagram showing a signal processor of a liquid crystal display device according to a second embodiment.

FIGS. 4A and 4B are schematic block diagrams showing signal processors of liquid crystal display devices according to first and second embodiments of the present invention, respectively. The figures and description of the electronics block diagrams are made as functional circuit elements, however the same result may be obtained using a microprocessor executing a program of stored instructions and having interfaces such as analog-to-digital and digital to analog converters. A combination of the two types of electronics may be used.

In FIG. 4A, a signal processor 170 receives a signal from a photo sensor 150 and transmits a control signal to the backlight unit 180. The signal processor 170 includes an I-V (current to voltage) converter 171, an A/D converter (analog to digital) 172, a latch part 173, an OR gate 174, a multiplexer (MUX) 175 and a reference voltage part 176. The I-V converter 171 converts a current-type signal into a voltage-type signal, and the A/D converter 172 converts an analog-type signal into a digital-type signal. The latch part 173 temporarily stores a signal and the OR gate 174 performs a logic sum of the output signal of the A/D converter 172 and the stored signal in the latch part 173. The multiplexer 175 selects a reference voltage according to a result of the OR gate 174 and the reference voltage part 176 supplies the reference voltage to the A/D converter 172.

The photo sensor 150 detects an ambient brightness and generates a current analog-type sense signal corresponding to the ambient brightness. The current analog-type sense signal is transmitted to the I-V converter 171 of the signal processor 170. The I-V converter 171 converts the current analog-type sense signal into a voltage analog-type sense signal and the voltage analog-type sense signal is transmitted to the A/D converter 172. The A/D converter 172 converts the voltage analog-type sense signal into a voltage digital-type using a reference voltage from the reference voltage part 176. The voltage digital-type sense signal is transmitted to the latch part 173. The latch part 173 temporarily stores the voltage digital-type sense signal and outputs the stored voltage digital-type sense signal as a control signal to the backlight unit 180 at a predetermined timing. The latch part 173 may include one of a flip-flop or a memory device.

The OR gate 174 logically sums the voltage digital-type sense signal outputted from the A/D converter 172 and the voltage digital-type sense signal stored in the latch part 173. Accordingly, when at least one of the voltage digital-type sense signal of the output from the A/D converter 172 and the voltage digital-type sense signal of a previous time stored in the latch part 173 has a high level, the OR gate 174 has a high level output. In addition, when both the digital voltage type sense signal output from the A/D converter 172 and the digital voltage-type sense signal previously stored in the latch part 173 have a low level, the OR gate 174 has a low-level output.

The multiplexer 175 selects one of a high level reference voltage or a low level reference voltage according to the output of the OR gate 174. For example, the multiplexer 175 may select a low-level reference voltage when the OR gate 174 has the high-level output and may select a high-level reference voltage when the OR gate 174 has the low-level output. The reference voltage part 176 supplies one of the high or the low level reference voltages to the A/D converter 172 according to the selection result of the multiplexer 175.

As a consequence, the signal processor 170 supplies a control signal to the backlight unit 180 using a reference voltage according to one of an upper hysteresis voltage or a lower hysteresis voltage. The hysteresis voltage means that a voltage supplied to the backlight unit is determined by the luminance variation instead of an absolute luminance. Accordingly, when the reference voltage according to the upper hysteresis voltage is used in the signal processor 170, a voltage supplied to the backlight lamp 180*a* has a relatively great difference from a previous value. In addition, when the reference voltage according to the lower hysteresis voltage is used in the signal processor 170, a voltage supplied to the backlight lamp 180*a* has a relatively small difference from a previous value.

The backlight unit 180 supplies light emitted from the backlight lamp 180*a* to the liquid crystal panel 100 and the backlight driver 180*b* controls the luminance of the backlight lamp 180*a* according to the control signal from the signal processor 170. Initially, the backlight driver 180*b* drives the backlight lamp 180*a* with a set voltage. Subsequently, the backlight driver 180*b* drives the backlight lamp 180*a* with a driving voltage according to the control signal from the latch part 173 of the signal processor 170. Further, a buffer unit (not shown) may be connected between the latch part 173 of the signal processor 170 and the backlight unit 180.

Therefore, when the ambient brightness is higher than a reference brightness, the backlight driver 180*b* supplies a high-level voltage to the backlight lamp 180*a* and the backlight lamp 180*a* emits light of a high-level luminance. Accordingly, deterioration of the LCD device in brightness and contrast ratio due to the high-level ambient brightness is prevented. In addition, when the ambient brightness is lower than the reference brightness, the backlight driver 180*b* supplies-a low-level voltage to the backlight lamp 180*a* and the backlight lamp 180*a* emits light of a low level luminance. Accordingly, unnecessary power consumption under a circumstance of the low-level ambient brightness is prevented.

In FIG. 4B, a signal processor 270 receives a signal from a photo sensor 250 and transmits a control signal to the backlight unit 280. The signal processor 270 includes an I-V (current-to-voltage) converter 271, an A/D converter (analog-to-digital) 272, a first latch part 273, a second latch part 277, a third latch part 279, an EX-NOR gate 278, an OR gate 274, a multiplexer (MUX) 275 and a reference voltage part 276. The I-V converter 271 converts a current-type signal into a voltage-type signal, and the A/D converter 272 converts an analog-type signal into a digital-type signal. The first latch part 273 and the second latch part 277 are operated according to a first clock "CLK1" and a second clock "CLK2," respectively, and are connected in parallel to the A/D converter 272. The first and second clocks "CLK1" and "CLK2" have equal pulse widths and different timings for a rising edge. The first and second latch parts 273 and 277 temporarily store a signal, and the EX-NOR gate 278 performs a logic exclusive sum and an inverse of the stored signals in the first and second latch parts 273 and 277. The OR gate 274 performs a logic sum of the output signal of the A/D converter 272 and the stored signal in the first latch part 273. The multiplexer 275 selects a reference voltage according to a result of the OR gate 274, and the reference voltage part 276 supplies the reference voltage to the A/D converter 272.

The photo sensor 250 detects an ambient brightness and generates a current analog-type sense signal corresponding to the ambient brightness. The current analog-type sense signal is transmitted to the I-V converter 271 of the signal processor 270. The I-V converter 271 converts the current analog-type sense signal into a voltage analog-type sense signal and the voltage analog-type sense signal is transmitted to the A/D converter 272. The A/D converter 272 converts the voltage analog-type sense signal into a voltage digital-type sense signal using a reference voltage from the reference voltage part 276. The voltage digital voltage-type sense signal is transmitted to the first latch part 273. The first latch part 273 is enabled by the first clock "CLK1" and temporarily stores the voltage digital-type sense signal. In addition, the first latch part 273 outputs the stored voltage digital-type sense signal to the OR gate 274, the EX-NOR gate 278 and the third latch part 279.

The OR gate 274 logically sums the voltage digital-type sense signal output from the A/D converter 272 and the voltage digital-type sense signal stored in the first latch part 273. Accordingly, when at least one of the voltage digital-type sense signal output from the A/D converter 272 and the voltage digital-type sense signal stored in the first latch part 273 has a high level, the OR gate 274 has a high-level output. In addition, when both the voltage digital type sense signal just outputted from the A/D converter 272 and the voltage digital type sense signal stored in the first latch part 273 have a low level, the OR gate 274 has a low level output.

The multiplexer 275 selects one of a high level reference voltage and a low level reference voltage according to the output of the OR gate 274. For example, the multiplexer 275 may select a low level reference voltage when the OR gate 274 has the high level output and may select a high level reference voltage when the OR gate 274 has the low level output. The reference voltage part 276 supplies one of the high and low level reference voltages according to the selection result of the multiplexer 275 to the A/D converter 272.

The second latch part 277 is enabled by the second clock "CLK2" and temporarily stores the voltage digital-type sense signal. In addition, the second latch part 277 outputs the stored voltage digital-type sense signal to the EX-NOR gate 278. The EX-NOR gate 278 logically exclusively sums and inverses the voltage digital type sense signals stored in the first and second latch parts 273 and 277. Since the first and second latch parts 273 and 277 are enabled at different timings due to the first and second clocks "CLK1" and "CLK2," the EX-NOR gate 278 logically exclusively sums and inverses the voltage digital type sense signals corresponding to ambient luminances at different times. Accordingly, the EX-NOR gate 278 has a high level output and the signal processor 270 outputs the control signal to the backlight unit 280 only when the ambient luminances at different timings are the same as each other. This operation of the EX-NOR gate 278 is performed for improving reliability in a resultant signal from the third latch part 279. As a result, reliability of the sense signal in view of voltage progress is obtained through the first latch part 273, the OR gate 274 and the multiplexer 275, and reliability of the sense signal in view of time progress is obtained through the first latch part 273, the second latch part 277 and the EX-NOR gate 278 using the first and second clocks "CLK1" and "CLK2."

The third latch part 279 temporarily stores the voltage digital type sense signal of the first latch part 273 and outputs the stored voltage digital-type sense signal as the control signal to the backlight unit 280 at a predetermined timing according to the resultant output of the EX-NOR gate 278.

The backlight unit 280 supplies light emitted from the backlight lamp 280*a* to the liquid crystal panel 100 and the backlight driver 280*b* controls the luminance of the backlight lamp 280*a* according to the control signal from the signal processor 270. Initially, the backlight driver 280*b* drives the backlight lamp 280*a* with a set voltage. Subsequently, the backlight driver 280*b* drives the backlight lamp 280*a* with a driving voltage according to the control signal from the third latch part 279 of the signal processor 270. Further, a buffer unit (not shown) may be connected between the third latch part 273 of the signal processor 270 and the backlight unit 280.

Consequently, in an LCD device, brightness and contrast ratio under a bright ambient luminance are improved and power consumption under a dark ambient luminance is reduced by adjusting a backlight unit according to the condition of ambient luminance. In addition, reliability of sense signal of a photo sensor is obtained by supplying a hysteresis voltage, and reliability of sense signal of a photo sensor is obtained by using the additional latch parts and clocks.

It will be apparent to those skilled in the art that various modifications and variations can be made in the liquid crystal display device and a method of driving the same of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel;

a backlight unit supplying light to the liquid crystal panel;

a photo sensor detecting an ambient brightness of surrounding the liquid crystal panel; and a signal processor configured to adjust a luminance of the light supplied by the backlight unit and includes a current to voltage converter converting an current analog-type sense signal output from the photo sensor into a voltage analog-type sense signal, an analog-to-digital (A/D) converter converting the voltage analog-type sense signal into a voltage digital-type sense signal, a latch part temporarily storing the voltage digital-type sense signal and outputting the voltage digital-type sense signal to the backlight unit, an OR gate logically summing the voltage digital-type sense signal from the analog-to-digital (ND) converter and the voltage digital-type sense signal stored in the latch part, a multiplexer selecting a reference voltage according to a result of the OR gate, and a reference voltage part supplying a hysteresis voltage to the A/D converter according to the reference voltage.

2. The device according to claim 1, wherein the photo sensor and the signal processor are formed in the liquid crystal panel, and the signal processor and the liquid crystal panel include a polycrystalline silicon.

3. The device according to claim 2, wherein the liquid crystal panel includes a first substrate, a second substrate and a liquid crystal layer between the first and second substrates, and the photo sensor and the signal processor are formed on the first substrate.

4. The device according to claim 3, wherein the photo sensor includes one of a photo diode or a photo transistor, and wherein a portion of the photo sensor includes amorphous silicon and the other portion of the photo sensor includes polycrystalline silicon.

5. The device according to claim 1, wherein the first clock has a same pulse width as, and a different timing for a rising edge, from the second clock.

6. The device according to claim 1, further comprising a buffer unit between the signal processor and the backlight unit.

7. The device according to claim 1, wherein the backlight unit supplies light of a first luminance when the ambient brightness is lower than a reference brightness and supplies light of a second luminance greater than the first luminance when the ambient brightness is higher than the reference brightness.

8. A method of driving a liquid crystal display device, comprising:

detecting an ambient brightness surrounding a liquid crystal panel and generating a current analog-type sense signal;

converting the current analog-type sense signal into a voltage digital-type sense signal;

generating a hysteresis voltage using the voltage digital-type sense signal;

generating a control signal using the hysteresis voltage; and adjusting a luminance of a light supplied to the liquid crystal panel according to the control sense signal, wherein generating the hysteresis voltage using the voltage digital-type sense signal includes storing the voltage digital-type sense signal for a clock period, logically summing the voltage digital-type sense signal of the previous clock period and the voltage digital-type sense signal of the present clock period to output one of a high- or a low-level reference voltage, outputting an upper hysteresis voltage when the low-level reference voltage is output, and outputting a lower hysteresis voltage when the high-level reference voltage is output.

9. The method according to claim 8, wherein converting the current analog-type sense signal into the voltage digital-type sense signal comprises:

converting the current analog-type sense signal into a voltage analog-type sense signal using a current-to-voltage (I-V) converter; and converting the voltage analog-type sense signal into the voltage digital-type sense signal using an analog-to-digital (A/D) converter.

10. A liquid crystal display device, comprising:

a liquid crystal panel;

a backlight unit supplying light to the liquid crystal panel;

a photo sensor detecting an ambient brightness surrounding the liquid crystal panel; and a signal processor configured to adjust a luminance of the light supplied by the backlight unit and includes a current-to-voltage (I-V) converter converting a current analog-type sense signal output from the photo sensor into a voltage analog-type sense signal, a analog-to-digital (ND) converter converting the voltage analog-type sense signal into a voltage digital-type sense signal, a first latch part temporarily storing the voltage digital-type sense signal and enabled by a first clock, a second latch part temporarily storing the voltage digital-type sense signal and enabled by a second clock, an OR gate logically summing the voltage digital-type sense signal from the A/D converter and the voltage digital-type sense signal stored in the first latch part, a multiplexer selecting a reference voltage according to a result of the OR gate, a reference voltage part supplying a hysteresis voltage to the A/D converter according to the reference voltage, an EX-NOR gate logically summing and inverting the voltage digital-type sense signals stored in the first and second latch parts, a third latch part temporarily storing the voltage digital-type sense signal stored in the first latch part and outputting the voltage digital-type sense signal to the backlight unit according to an output of the EX-NOR gate.

11. A method of driving a liquid crystal display device, comprising:

detecting an ambient brightness surrounding a liquid crystal panel and generating a current analog-type sense signal;

converting the current analog-type sense signal into a voltage digital-type sense signal;

generating a hysteresis voltage using the voltage digital-type sense signal;

storing the voltage digital-type sense signals at first and second clock periods;

logically exclusively summing and inverting the voltage digital-type sense signals of the first and second clock periods to output a result signal;

generating a control signal using the hysteresis voltage; and adjusting a luminance of a light supplied to the liquid crystal panel according to the control sense signal, wherein the control signal is outputted according to the result signal.

12. The method according to claim 11, wherein the voltage digital-type sense signals are stored at the first and second clock periods using first and second clocks having a same pulse width as, and a different timing for a rising edge, from each other.

* * * * *

UNITED STATES PATENT AND TRADEMARK OFFICE

CERTIFICATE OF CORRECTION

PATENT NO. : 7,768,497 B2
APPLICATION NO. : 11/639919
DATED : August 3, 2010
INVENTOR(S) : Kyoung-Moon Lim It is certified that error appears in the above-identified patent and that said Letters Patent is hereby corrected as shown below:

In the Claims

In column 8, claim 1, line 42, before "converter and the voltage" replace "(ND)" with --(A/D)--.

In column 9, claim 10, line 2, before "converter converting the" replace "(ND)" with --(A/D)--.

Signed and Sealed this
Fifteenth Day of February, 2011

David J. Kappos

David J. Kappos
*Director of the United States Patent and Trademark Office*